US008734615B2

(12) United States Patent
Unger et al.

(10) Patent No.: US 8,734,615 B2
(45) Date of Patent: May 27, 2014

(54) METHOD AND SYSTEM FOR IMPREGNATING AND DRYING A CONTINUOUS PAPER WEB

(75) Inventors: Udo Unger, Leichlingen (DE); Adnan Doengelli, Gladbeck (DE); Daniel James, Langenfeld (DE); Willi Erkelenz, Langenfeld (DE)

(73) Assignee: Vits Technology GmbH, Lagenfeld (DE)

( * ) Notice: Subject to any disclaimer, the term of this patent is extended or adjusted under 35 U.S.C. 154(b) by 0 days.

(21) Appl. No.: 13/878,593

(22) PCT Filed: Nov. 4, 2011

(86) PCT No.: PCT/EP2011/069407
§ 371 (c)(1), (2), (4) Date: May 14, 2013

(87) PCT Pub. No.: WO2012/069301
PCT Pub. Date: May 31, 2012

(65) Prior Publication Data

US 2013/0228300 A1 Sep. 5, 2013

(30) Foreign Application Priority Data

Nov. 23, 2010 (DE) ..... 10 2010 052 044

(51) Int. Cl.
*D21H 11/00* (2006.01)

(52) U.S. Cl.
USPC ..... 162/161; 162/158; 162/141; 34/364

(58) Field of Classification Search
USPC ..... 162/161, 250, 158; 428/500; 427/411; 34/364, 79, 86
See application file for complete search history.

(56) References Cited

U.S. PATENT DOCUMENTS

| | | | |
|---|---|---|---|
| 4,317,290 | A | 3/1982 | Voswinckel |
| 5,333,395 | A | 8/1994 | Bulcsu |
| 5,528,839 | A | 6/1996 | Seidl |
| 5,714,269 | A | 2/1998 | Munoz-Madrid |
| 2011/0159208 | A1 | 6/2011 | Price |

FOREIGN PATENT DOCUMENTS

| | | | |
|---|---|---|---|
| CA | 2283921 | * | 9/1998 |
| DE | 19623303 | A | 1/1997 |
| EP | 1134529 | A | 9/2001 |
| EP | 0966641 | B | 1/2002 |

* cited by examiner

*Primary Examiner* — Mark Halpern
(74) *Attorney, Agent, or Firm* — Andrew Wilford

(57) ABSTRACT

The invention relates to a method for impregnating and drying a continuous paper web (1) by means of a urea resin dissolved in water, and to a corresponding system. Such paper webs (1) are employed for example as furniture foil or floor laminate, wherein in the known art melamine resin is used exclusively for bonding to a substrate. This is relatively expensive. Therefore the object of the invention is to create a method in which the paper web (1) which is impregnated by means of urea resin can be bonded to the substrate with a high degree of operational reliability. Said object is achieved in that the temperature of the paper web (1) is determined separately in each of the drying zones (3.1, 3.2, 3.3, 3.4), that for each of the drying zones (3.1, 3.2, 3.3, 3.4) an amount and/or a temperature of the circulating air are regulated so that the maximum temperature of the paper web (1) is 99° C., and that exhaust air is extracted from a first one of the drying zones (3.1, 3.2, 3.3, 3.4) and fresh air is supplied to a last one of the drying zones (3.1, 3.2, 3.3, 3.4).

12 Claims, 1 Drawing Sheet

METHOD AND SYSTEM FOR IMPREGNATING AND DRYING A CONTINUOUS PAPER WEB

CROSS REFERENCE TO RELATED APPLICATIONS

This application is the US-national stage of PCT application PCT/EP2011/069407 filed 4 Nov. 2011 and claiming the priority of German patent application 102010052044.6 itself filed 23 Nov. 2010.

FIELD OF THE INVENTION

The invention relates to a method of impregnating and drying a continuous paper web with a urea resin dissolved in water where a metered quantity of the urea resin is applied to the paper web, the paper web is passed in suspended fashion through heated air in a dryer and dried to a predetermined residual moisture content, at least one portion of the air is recirculated, a temperature of the paper web is measured, and drying is controlled by modifying the drying parameters in a plurality of different drying zones.

The invention furthermore relates to a corresponding system to carry out the method.

BACKGROUND OF THE INVENTION

Paper webs of this type are known per se; they are used for example as furniture films or as a flooring laminate. Strict specifications must be met here in terms of quality. For this reason, expensive melamine resins are predominantly used in practice to effect impregnation.

Decor papers are impregnated here with the melamine resin and dried by heated air. When applied with heat and pressure to the substrate, for example particleboard, the melamine resin produces a scratch-free surface and ensures that the decor paper is reliably bonded to the substrate. Significantly cheaper urea resin can be used for an initial impregnation in order to reduce costs. In this case, both sides of the impregnated web must be coated with melamine resin in order to achieve the required surface properties for the laminate and to ensure reliable bonding to the board.

Conventional drying processes do not allow the web that is impregnated with pure urea resin to be adhesively bonded to the substrate.

EP 0966641 discloses a method of impregnating and drying a paper web in which the requisite application of melamine resin is controlled based on measured values for grammage. Drying is effected by heated air and is controlled based on the final moisture content of the impregnated paper.

It is desirable as much as possible to substitute is significantly cheaper urea resin for the melamine resin to impregnate paper webs.

WO 2008/134823 describes a method of making impregnated paper in which urea resin is used for the impregnation. near-infrared radiant heat is used for drying such that crosslinking of the resin is largely prevented. When the film impregnated with the urea resin is pressed against the substrate, the low level of crosslinking ensures reliable adhesive bonding. One disadvantage of the method is that it does not provide the requisite operational reliability. The method furthermore requires the use of expensive electrical energy. In the case of variegated patterns, areas of different colors dry differently due to variation in absorption and reflection, with the result that the overall web has a nonuniform moisture content.

OBJECT OF THE INVENTION

A first object of this invention is therefore to provide a method that has the required operational reliability in which crosslinking of the urea resin is largely prevented, and that ensures uniform drying even for all decor variants while reducing the cost in energy.

A further object of the invention is to create a system for carrying out the method.

SUMMARY OF THE INVENTION

This first object is achieved in that the temperature of the paper web is measured and controlled separately in each drying zone, and the quantity and/or temperature of the recirculating air is controlled for each of the drying zones such that the temperature of the paper web reaches a maximum of 99° C., preferably, a maximum of between 80° C. and 85° C. This approach is reliably ensures that the temperature critical for the urea resin is not exceeded in any of the drying zones, while the required level of drying is nevertheless achieved very uniformly. In particular, crosslinking of the urea resin is largely prevented, thereby ensuring secure bonding to for example the board during subsequent lamination. Unlike previous practice, this then enables the substantially cheaper urea resin to be used. The critical factor allowing this is the prevention of crosslinking.

Exhaust air from a furthest upstream one of the drying zones is drawn off, while fresh air is supplied to a furthest downstream one of the drying zones (directional information, positions, and the like always refer in this application to a travel direction of the paper web). The result here is that the largest possible quantity of fresh air and at the same time the smallest quantity of exhaust air pass through each of the drying zones. Controlling the volume and/or the temperature of the recirculating air as a function of the temperature of the paper web enables a high temperature to be provided in a furthest upstream one of the drying zones relative to the travel direction of the paper web along with at the same time a large circulation volume. No air, or only very little air, can reach the next drying zone in which there is a lower temperature. The paper web can thus be reliably maintained at the maximum temperature such that high evaporation rates can be achieved, in particular in the furthest upstream drying zone. In overall terms, temperatures that are graduated from high to low can be set without any significant mutual effect, thereby enabling an overall high evaporation rate to be achieved in spite of the paper web's low temperature. What is prevented, in particular, is a condition where air from one drying zone at higher temperature and with high water content passes into a downstream adjacent drying zone of lower temperature so as to thereby produce an unwanted high temperature in the paper web.

The urea resin has the additional advantage that it is of low viscosity and thus impregnates the paper web more effectively and quickly. As a result, this simplifies impregnation.

In addition, the paper web that has been impregnated with urea resin and subsequently dried can be printed, thereby enabling a printed decor pattern to be modified quickly without the need to replace a supply roll for the paper web. This aspect significantly simplifies maintaining the supply of paper webs.

In an especially advantageous embodiment of the method, fresh air is preheated by the exhaust air in a heat exchanger. This enables the energy consumption for drying to be reduced.

In another embodiment, the uncontrolled entry of ambient air into the dryer is prevented to the extent technically useful; for this purpose appropriate air locks are provided at the inlet into and at the outlet of the paper web from the dryer, at which points for example sealing air is supplied. This approach ensures that the fresh air essentially enters only the furthest downstream of the drying zones.

In another embodiment, the air is heated directly by combustible gas, the combustion gases generated thereby being mixed with air extracted from one of the drying zones and then supplied as heating gas to this drying zone. In this case, a separate burner is associated with each drying zone. Mixing and thus cooling the combustion gases with the air from the drying zones results in a substantial reduction in exhaust air from the dryer; less fresh air needs to be heated.

In another embodiment, the relative humidity of the air in the dryer is a maximum of 10%, preferably, a maximum of 5%. This yields a high level of water absorption from the air, and thus gentle and rapid drying.

In another embodiment, the temperature of the air in the furthest upstream drying zone ranges between 120° C. and 300° C., preferably 150° C. and 200° C., and in the furthest downstream drying zone ranges between 60° C. and 100° C., preferably 70° C. and 90° C. The temperature of the air in the drying zones between the furthest upstream and furthest downstream one is adjusted to values between the value of the furthest upstream and the value of the furthest downstream drying zone, such that the temperature is reduced in graduated fashion in the travel direction of the paper web from one drying zone to the next drying zone. This approach produces the highest possible evaporation rate for each drying zone without exceeding the allowable temperature for the paper web.

In another advantageous embodiment, melamine resin is applied to the paper web after drying. This enables a qualitatively higher-grade surface to be achieved for the surface of the finished coated paper. This largely satisfies the requirements for a paper web that has been impregnated and/or coated exclusively with melamine resin—yet production costs are significantly reduced when using the method according to the invention.

BRIEF DESCRIPTION OF THE DRAWING

The following describes the invention in more detail based on the schematic drawing. Therein.

SPECIFIC DESCRIPTION OF THE INVENTION

Figure 1:
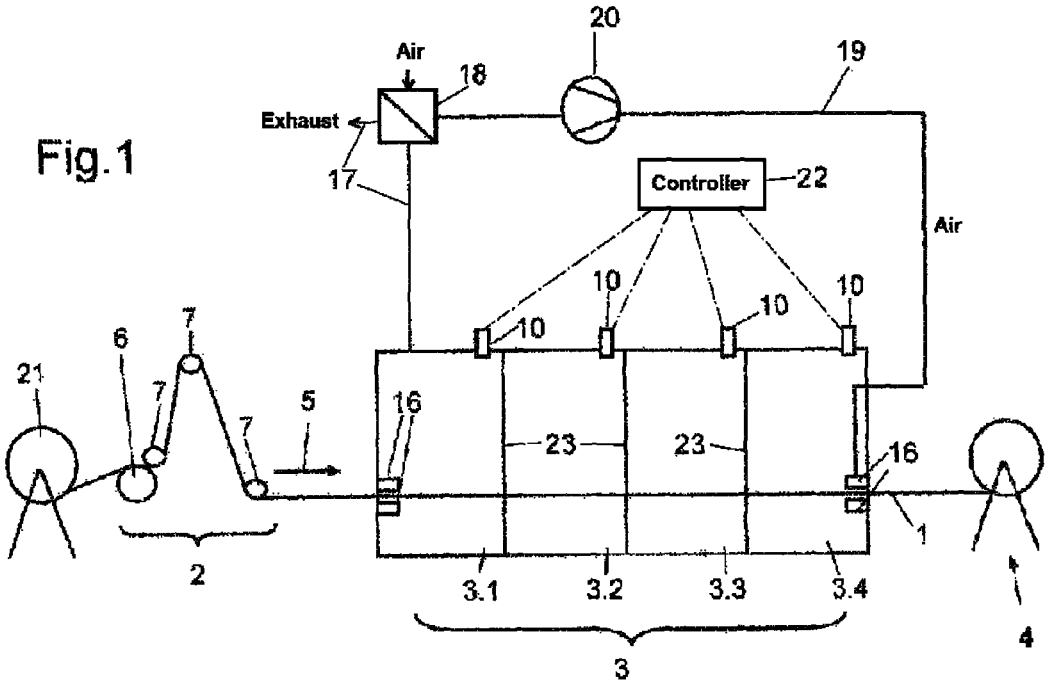
FIG. 1 is a diagram of a system for impregnating and drying a continuous paper web.

As shown in FIG. 1, a system for impregnating and drying a continuous paper web 1 comprises an upstream applicator 2 for a metered application of urea resin, and a dryer 3. A winder 4 preferably follows the dryer 3 and functions to wind up the impregnated paper web 1 that is conveyed in the direction indicated by an arrow 5.

The upstream applicator 2 comprises an application roller 6, deflecting rollers 7, and equipment, not shown, for supplying the urea resin, all operated by a controller 22.

The dryer 3 is constructed in modular form from essentially similarly designed drying zones 3.1, 3.2, 3.3, 3.4, and is enclosed by a housing. Partition walls 23 are provided between adjacent drying zones 3.1, 3.2, 3.3, 3.4.

Figure 2:
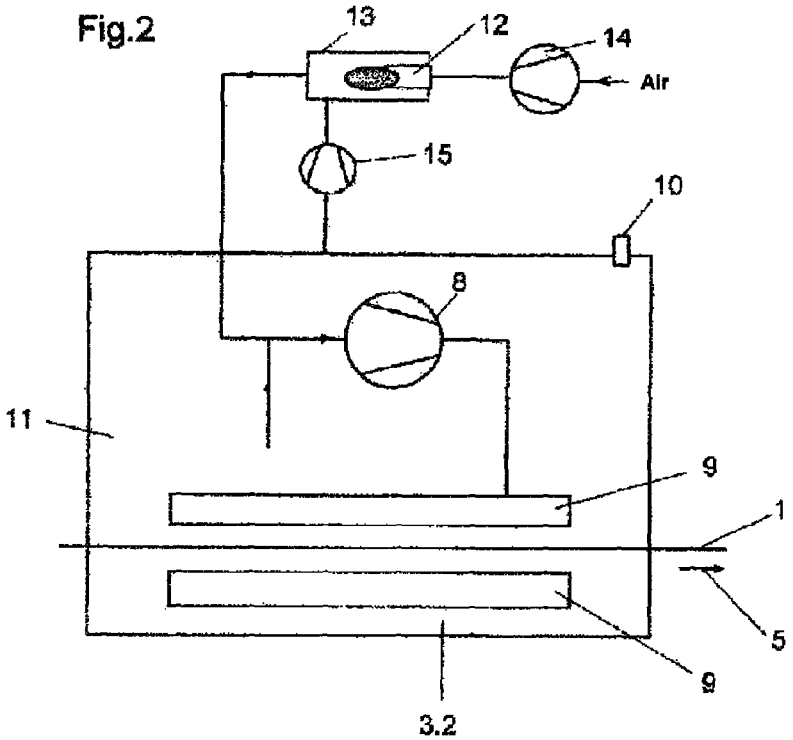
FIG. 2 is a diagram of a gas-heated drying zone.

As is especially evident in FIG. 2, each drying zone 3.1, 3.2, 3.3, 3.4 comprises a recirculating fan 8, nozzle boxes 9 that are provided below and above the paper web 1 to blow recirculating air onto the paper web 1, equipment to heat the recirculating air, and channels or ducts to conduct the recirculating air. A sensor 10 is provided in each drying zone 3.1, 3.2, 3.3, 3.4 so as to allow the temperature of the paper web 1 to be measured in the downstream region of each of the drying zones 3.1, 3.2, 3.3, 3.4. The sensor 10 is for example a non-contact infrared sensor. The recirculating fan 8 is provided in a low-pressure chamber 11 of the respective drying zone 3.1, 3.2, 3.3, 3.4, and is connected by a conduit to the intake of the respective nozzle box 9.

The equipment to heat the recirculating air comprises a gas burner 12 including a burner tube 13 and a combustion-air fan 14, a mixing-air fan 15, and connecting gas conduits. The intake of the mixing-air fan 15 is connected to the low-pressure chamber 11, and its output is connected to the burner tube 13. One outlet of the burner tube 13 is connected to the low-pressure chamber 11 in such a way as to prevent during operation any mixing of recirculating air drawn in from the mixing-air fan 15 with the heated recirculating air introduced into the low-pressure chamber 11 from the outlet of the burner tube 13.

Alternatively, the equipment for heating the recirculating air comprises an unillustrated first heat exchanger that is connected with the intake of the recirculating fan 8 and can be supplied with a heating medium such as fuel oil or steam.

An air lock 16 is provided at an inlet of the paper web 1 into the furthest upstream drying zone 3.1 and at an outlet from the furthest downstream drying zone 3.4. Each air lock 16 is supplied separately with fresh air so as to largely prevent any unwanted entry of ambient air into and any escape of air from the dryer 3.

An exhaust duct 17 is connected to the furthest upstream drying zone 3.1 on the housing, which duct transitions into a flue after a second heat exchanger 18. A fresh-air supply duct 19 is furthermore connected to the second heat exchanger 18 and leads to the furthest downstream drying zone 3.4. A fresh-air fan 20 is integrated in the fresh-air duct 19 to increase pressure therein.

During operation, the paper web 1 is drawn from a supply roll 21 and passed through the upstream applicator 2. In the known approach, the urea resin in aqueous solution is uniformly applied to the paper web 1, and is metered out at a predetermined grammage of for example 50 g of urea resin (dry weight) per $m^2$. The urea resin impregnates the paper web 1 so that the web is uniformly saturated.

The impregnated paper is then supplied to the dryer 3, conveyed through the dryer in suspended fashion in the travel direction, and dried to a residual moisture content of for example 7%. To this end, the paper web 1 is exposed to heated recirculating air in the drying zones 3.1, 3.2, 3.3, 3.4.

The recirculating air is moved by the respective recirculating fan 8 in each of the drying zones 3.1, 3.2, 3.3, 3.4. The recirculating air is drawn here from the low-pressure chamber 11, heated by the burner exhaust gases from the gas burner 12, moved by the recirculating fans 8 into the respective nozzle boxes 9, and when exiting them is blown onto the paper web 1 so as to keep the web suspended. In order to cool them, the burner exhaust gases are mixed with air from the drying zones 3.1, 3.2, 3.3, 3.4, the air being drawn by the mixing-air fan 15 from the respective drying zone 3.1, 3.2, 3.3, 3.4, and introduced into the respective burner tube 13. The gas mixture thus generated is passed into the respective suction zone 11 in the immediate intake area of the respective recirculating fan 8 as heated air to heat the recirculating air. The heated air is thus supplied directly to the intake side of the recirculating fan 8 so as to prevent any further mixing with the air drawn from the mixing-air fan 15.

The recirculating air in the drying zones 3.1, 3.2, 3.3, 3.4 is adjusted so that it has a low relative humidity of less than 5%. Since the temperature of the paper web 1 is controlled to be 80° C. in all the drying zones 3.1, 3.2, 3.3, 3.4, this yields the highest possible temperature for the recirculating air given a high water evaporation rate, and thus a low relative humidity for all the drying zones 3.1, 3.2, 3.3, 3.4. The fresh air portion is preheated in the second heat exchanger 18 by the exhaust air from the furthest upstream drying zone 3.1, and passed by the fresh-air fan 20 through the fresh air duct into the furthest downstream drying zone 3.4.

The exhaust air is discharged through the exhaust air duct 17 from the drying zone 3.1, cooled in the heat exchanger 18, and—optionally after being treated—discharged through a flue to the outside. The quantity of exhaust air, and thus also the quantity of fresh air, are determined and controlled using the known approach as a function of the process conditions.

The temperature of the paper web 1 is measured by the sensor 10 at the end of each drying zone 3.1, 3.2, 3.3, 3.4. The temperature and/or the quantity of air (circulating air) for each drying zone 3.1, 3.2, 3.3, 3.4 is controlled so that the temperature of the paper web 1 is 80° C. The temperature is at its highest in the furthest upstream drying zone 3.1 at for example 180° C., then falls down for example to 110° C. in the second drying zone 3.2, 90° C. in the third drying zone 3.3, and 80° C. in the furthest downstream drying zone 3.4. This aspect thus reliably prevents the urea resin from crosslinking excessively.

Additional measuring probes and control circuits can be provided, where the temperature of the paper web 1 is the determining control variable.

After drying, the impregnated paper web 1 is wound by the winder 4 into a roll.

Alternatively, the paper web 1 is cut into sheets by a cross-cutter.

In an alternative embodiment of the invention, a printer, not shown, is provided between the dryer 3 and winder 4, which printer when operating prints a decorative pattern on one side of the impregnated the paper web 1.

In another alternative embodiment of the invention, a second applicator is provided between the dryer 3 and winder 4, or between the printer and winder 4, which applicator by the known approach applies and meters out melamine resin to the optionally printed side. The layer of melamine resin is then dried in another drying device where a maximum temperature of 99° is maintained.

The invention claimed is:

1. A method of treating a continuous paper web, the method comprising the steps of:

applying metered quantities of a urea resin dissolved in water to the paper web;

passing the paper web in a travel direction through a succession of drying zones of a dryer;

recirculating at least a portion of the air in each of the dryer zones by passing a portion of the air in each zone through a respective heater and a respective blower and blowing the hot air produced in the heater as recirculating air from the respective blower against the web from a respective nozzle system;

monitoring a temperature in each of the drying zones;

modifying the temperature of the paper web in each of the drying zones by controlling a quantity or a temperature of the recirculating air via the respective blowers and/or heaters for each of the drying zones so that the temperature of the paper web reaches a maximum of 99° C.; and extracting exhaust air exclusively from a furthest upstream one of drying zones and supplying fresh air exclusively to a furthest downstream one of the drying zones as part of the recirculating air such that the air in the zones moves upstream from zone to zone.

2. The method according to claim 1, further comprising the step of:

preheating the fresh air by the exhaust air.

3. The method according to claim 1, further comprising the step of:

preventing uncontrolled entry of ambient air into the dryer.

4. The method according to claim 1, wherein each heater heats the recirculating air for the respective zone directly by burning combustible gas and thereby generating combustion gases; and the blowers each mix the generated combustion gases with air drawn from the respective drying zone and then supply the mixed combustion gas and air as heating gas to the respective drying zone.

5. The method according to claim 1, further comprising the step of:

restricting a maximum humidity of the recirculating air in the dryer to 10%.

6. The method according to claim 1, wherein the temperature of the recirculating air is maintained between 120° C. and 300° C. in the furthest upstream drying zone, and between 60° C. and 100° C. in the furthest downstream drying zone.

7. The method according to claim 1, further comprising the step after drying of:

applying a melamine resin to the paper web.

8. A system for treating a continuous paper web, the system comprising:

a dryer having a row of dryer zones succeeding one another in a travel direction;

conveyor means for transporting the web in the direction successively through the zones;

applicator means upstream of the dryer for controlledly applying a urea resin dissolved in water to the paper web;

respective blowers and heaters for recirculating and heating at least a portion of the air in each of the zones;

means for extracting air from a furthest upstream one of the zones;

means for taking in and heating fresh air, and for introducing the heated fresh air as part of the recirculating air into a furthest downstream one of the zones such that air moves generally upstream in the dryer from zone to zone;

respective temperature sensors in the zones; and control means connected to the blowers and/or the heaters and to the sensors for modifying a temperature or quantity of the recirculating air in each of the drying zones so that a temperature of the paper web reaches a maximum of 99° C. before exiting the dryer.

9. The system according to claim 8, further comprising:

a heat exchanger; and means for circulating the fresh air before introduction into the furthest downstream zone and the exhaust air after withdrawal from the upstream zone through the heat exchanger to heat the fresh air with the exhaust air.

10. The system according to claim 8, further comprising:

respective upstream and downstream air locks at an inlet of the paper web into the furthest upstream zone of the dryer and at an outlet of the furthest downstream zone of the dryer.

11. The system according to claim 8, wherein the heating means includes:

a burner tube for burning combustion gases and thereby producing combustion gases for each drying zone, and a fan for mixing air with the combustion gases in the burner tube and for feeding the combustion gases mixed with the air as heating gas into the drying zone.

12. The system according to claim 8, further comprising:

second applicator means for applying melamine resin to the web downstream of the dryer.

* * * * *